US007112077B2

(12) United States Patent
Kikuchi

(10) Patent No.: US 7,112,077 B2
(45) Date of Patent: Sep. 26, 2006

(54) CARD CONNECTOR HAVING CARD(S) DETECTION CAPABILITIES

(75) Inventor: Hitoshi Kikuchi, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 11/237,602

(22) Filed: Sep. 27, 2005

(65) Prior Publication Data

US 2006/0079106 A1 Apr. 13, 2006

(30) Foreign Application Priority Data

Oct. 7, 2004 (JP) ..... 2004-294514

(51) Int. Cl.
*H01R 29/00* (2006.01)

(52) U.S. Cl. ..... 439/188

(58) Field of Classification Search ..... 439/630, 439/631, 188

See application file for complete search history.

(56) References Cited

U.S. PATENT DOCUMENTS 6,129,570 A * 10/2000 Griffin et al. ..... 439/260
6,129,571 A * 10/2000 Ikemoto ..... 439/260
6,135,809 A * 10/2000 Asakawa ..... 439/489
6,749,450 B1 * 6/2004 Chen ..... 439/188
6,932,653 B1 * 8/2005 Takahashi et al. ..... 439/630
2001/0039129 A1 * 11/2001 Nishimura ..... 439/74

* cited by examiner

*Primary Examiner*—Tho D. Ta
*Assistant Examiner*—Vanessa Girardi
(74) *Attorney, Agent, or Firm*—Abelman, Frayne Schwab

(57) ABSTRACT

A card connector includes a required number of contacts, a housing holding and arranging said contacts therein and having a fitting opening into which the card is inserted, and a switching unit for detecting the insertion and removal of the card. The switching unit includes a first switching terminal and a second switching terminal. When the card is not yet inserted into the connector, the first and second switching terminals contact each other or do not contact each other, and when the card has been inserted into the connector, the first switching terminal is displaced obliquely downward in relation to the inserting direction of the card so that the first and second switching terminals do not contact each other or contact each other, thereby enabling the inserted or removed condition of said card to be detected with great certainty.

6 Claims, 5 Drawing Sheets

CARD CONNECTOR HAVING CARD(S) DETECTION CAPABILITIES

BACKGROUND OF THE INVENTION

This invention relates to a card connector for use in a various kinds of electric or electronic appliances such as printers and card readers, and more particularly to a card connector having a reliable detecting mechanism when a card is inserted and removed into and from the connector.

There have been many kinds of cards as media for a variety of information. It has been a common practice to obtain or accumulate various information from or onto a card which is adapted to be inserted into a card connector connected to an information appliance.

In using a card in such a manner, it is required to insert the card into a card connector with great certainty. Therefore, there is a need to ascertain whether the card has been completely inserted or not. For this purpose switching mechanisms are frequently used.

There have been switching mechanisms for detecting an inserted card into a connector by displacement of one element in a thickness direction (Patent Literature 1), a width direction (Patent Literature 2) or an inserting direction of the connector.

The mechanism for detecting by the displacement of the element in the inserting direction will be explained with FIGS. 5A and 5B. FIG. 5A is a view for explaining a state of switching terminals before inserting a card, while FIG. 5B is a view for explaining a state of the switching terminals when a card has been inserted. As shown in FIGS. 5A and 5B, the card connector 60 of the prior art mainly comprises a housing 62, contacts, and two switching terminals 66 and 68. Prior to the insertion of a card, the two switching terminals 66 and 68 are separated from each other. Upon insertion of a card, first the card will contact the first switching terminals 66 viewed on the lower side in the drawing. On proceeding of the insertion, the first switching terminal 66 moves in the inserting direction of the card (in the upward direction viewed in the drawing) so that the first switching terminal 66 is brought into contact with the second switching terminal 68, thereby detecting the fact that the card has been inserted in the connector.

Japanese Patent Application Opened No. H10-320,511/1998 (Patent Literature 1) discloses a card reader capable of detecting an inserted card by displacement of a switching element in a thickness direction. This card reader has a thin card case so as to obtain a suitable elastic displacement of a switching element and an appropriate contacting force by a slight force for inserting a card into the card reader, thereby achieving good wiping effect and contact caused by pressurized contact and deformation of first and second following switching elements. A card distal end detecting device comprises first and second following switch elements 1 and 2 whose first and second elastic contact pieces 5 and 6 extend along the surface of a memory card and are arranged opposite to the card in its thickness. The first elastic contact piece 5 is so arranged that after an electrode pad arranged on the surface of the inserted card begins to contact the contacts arranged in the card reader, the first elastic contact piece 5 is elastically displaced in the thickness direction of the card by an urging force of the front edge of the card and comes into contact with the second elastic contact piece 6. The second elastic contact piece 6 is so arranged that it is elastically displaced in the thickness direction of the card by an urging force by the first elastic contact piece 5 to perform wiping at the pressurized contact portion.

Japanese Patent Application Opened No. 2001-351,709 (Patent Literature 2) discloses a connector capable of detecting an inserted card by displacement of a switching element in a width direction. This invention has an object to provide a connector into which a plurality of memory cards different in thicknesses can be selectively inserted in order to operate information appliances. The connector includes a connector main body consisting of a rear wall and side walls formed along their full length with receiving portions conforming to side edges of memory cards to be used, card identification terminals in a plurality of rows on the inner surface of one side wall, terminals provided on the rear wall for writing the electronic information and reading the accumulated information onto and from the cards, and protection terminals provided at appropriate positions on the other side wall for prohibiting writing. The card identification terminals are made from a spring-like metal strip piece and arranged in a plurality of rows on the side wall, while identification tabs are arranged on the side wall to separate from the card identification terminals when a card is not inserted. When the identification tabs contact the card identification terminals, the existence of the card is identified.

In recent years, with the miniaturization of the information appliances as well as boards or substrates used therein, surface areas of the boards to be utilized have become extremely narrower. Such a limitation of the surface area of the board leads to the use of a plurality of boards. On the other hand, if a plurality of connectors are required for exchanging a plurality of memory cards, information appliances would become bulky which would be inconvenient for carrying them.

The proposals for detecting the insertion of a card are described above. With the switching mechanisms disclosed in the Patent Literatures 1 and 2, however, there would be clearances between a card and a card fitting opening of a connector. Therefore, if the card is inserted into the fitting opening in a state that one edge of the card on the side of the switch is closer to the side wall of the fitting opening than the other edge to the other side wall, then the insertion of the card would be prematurely identified prior to the complete insertion of the card. For the purpose of overcoming this problem, if the clearance between the card and the fitting opening is made as little as possible, the fabrication cost would go up, and the insertion of a card would become difficult.

With the connector which detects a card by the displacement of the switching terminal in the inserting direction of the card as shown in FIGS. 5A and 5B described above, moreover, in the case of a thinner card, the reaction force of the switching terminal would become larger so that the removing force for the card would not fulfil the removing force prescribed in the Standard of card, that is, normally more than 1N (98 g).

SUMMARY OF THE INVENTION

It is an object of the invention to provide a card connector which overcomes the problems of the prior art and which includes a switching mechanism capable of reliably detecting a card completely inserted into the connector.

In order to accomplish the above object, in a card connector 10 into and from which at least one card 32 is inserted and removed, including a required number of contacts 14 and 15 having a contact portion 141 and 151 adapted to contact the card 32, a housing 12 holding and arranging the contacts 14 and 15 therein and having a fitting opening 30 into which the card 32 is inserted, and switching means for detecting the insertion and removal of the card 32, according to the invention the switching means comprises a first switching terminal 16 and a second switching terminal 18, and when the card 32 is not yet inserted into the connector, the first and second switching terminals 16 and 18 contact each other or do not contact each other, and when the card 32 has been inserted into the connector, the first switching terminal 16 is displaced obliquely downward in relation to the inserting direction of the card 32 so that the first and second switching terminals 16 and 18 do not contact each other or contact each other, thereby enabling the inserted or removed condition of the card 32 to be detected.

In the case of a card connector having two fitting openings 30 into and from which two cards 32 are inserted and removed in upper and lower portions of the connector 10, including a required number of contacts 14 and 15 having a contact portion 141 and 151 adapted to contact the cards 32, a housing 12 holding and arranging the contacts 14 and 15 therein and having fitting openings 30 into which the cards 32 are inserted, respectively, and switching means for detecting the insertion and removal of the cards 32, in order to accomplish the above object according to the invention the switching means comprises a first switching terminal 16 and a second switching terminal 16 provided in the lower portion, and when the card 32 is not yet inserted into the connector, the first and second switching terminals 16 and 18 contact each other or do not contact each other, and when the card 32 has been inserted into the connector, the first switching terminal 16 is displaced obliquely downward in relation to the inserting direction of the card 32 so that the first and second switching terminals 16 and 18 do not contact each other or contact each other, thereby enabling the inserted or removed condition of the card 32 to be detected.

The first switching terminal 16 is substantially U-shaped and has a contact portion 161 at one end adapted to contact the card 32 and the second switching terminal 18, a connection portion 163 at the other end to be connected to a board, and fixed portion 162 between the contact portion 161 and the connection portion 163, and the second switching terminal 18 is substantially crank-shaped and has a contact portion 181 at one end adapted to contact the first switching terminal 16, a connection portion 183 at the other end adapted to be connected to a board, and a fixed portion 182 between the contact portion 183 and the connection portion 183, and the connection portions 163 and 183 of the first and second switching terminals 16 and 18 extend in a width direction of the housing 12.

In a preferred embodiment, the first switching terminal 16 is provided with an inclined portion 166 inclined obliquely upward from the contact portion 161 to the fixed portion 162. Moreover, upon insertion of the card 32, first the front edge of the card engages contact portion A 164 of the first switching terminal 16, upon further insertion of the card, the first switching terminal 16 is displaced obliquely downward in relation to the inserting direction of the card 32, and when the card 32 has been completely inserted, contact portion B 165 of the first switching terminal 16.

As can be seen from the above descriptions, the card connector according to the invention can bring about the following significant functions and effects.

(1) In a card connector 10 into and from which at least one card 32 is inserted and removed, including a required number of contacts 14 and 15 having a contact portion 141 and 151 adapted to contact the card 32, a housing 12 holding and arranging the contacts 14 and 15 therein and having a fitting opening 30 into which the card 32 is inserted, and switching means for detecting the insertion and removal of the card 32, according to the invention the switching means comprises a first switching terminal 16 and a second switching terminal 18, and when the card 32 is not yet inserted into the connector, the first and second switching terminals 16 and 18 contact each other or do not contact each other, and when the card 32 has been inserted into the connector, the first switching terminal 16 is displaced obliquely downward in relation to the inserting direction of the card 32 so that the first and second switching terminals 16 and 18 do not contact each other or contact each other, thereby enabling the inserted or removed condition of the card 32 to be detected. In this manner, an inserted card 32 can be reliably detected, even if there is any clearance between the card and the fitting opening and a card can be removed from the card connector with a removing force which fulfils the force of more than 1N (98 g) prescribed in the Standard of card even if the card is thinner.

(2) In the case of a card connector having two fitting openings 30 into and from which two cards 32 are inserted and removed in upper and lower portions of the connector 10, including a required number of contacts 14 and 15 having a contact portion 141 and 151 adapted to contact the cards 32, a housing 12 holding and arranging the contacts 14 and 15 therein and having fitting openings 30 into which the cards 32 are inserted, respectively, and switching means for detecting the insertion and removal of the cards 32, according to the invention the switching means comprises a first switching terminal 16 and a second switching terminal 16 provided in the lower portion, and when the card 32 is not yet inserted into the connector, the first and second switching terminals 16 and 18 contact each other or do not contact each other, and when the card 32 has been inserted into the connector, the first switching terminal 16 is displaced obliquely downward in relation to the inserting direction of the card 32 so that the first and second switching terminals 16 and 18 do not contact each other or contact each other, thereby enabling the inserted or removed condition of the card 32 to be detected. Accordingly, an inserted card 32 can be reliably detected, even if there is any clearance between the card and the fitting opening and a card can be removed from the card connector with a removing force which fulfils the force of more than 1N (98 g) prescribed in the Standard of card even if the card is thinner.

(3) According to the invention, the first switching terminal 16 is substantially U-shaped and has a contact portion 161 at one end adapted to contact the card 32 and the second switching terminal 18, a connection portion 163 at the other end to be connected to a board, and fixed portion 162 between the contact portion 161 and the connection portion 163, and the second switching terminal 18 is substantially crank-shaped and has a contact portion 181 at one end adapted to contact the first switching terminal 16, a connection portion 183 at the other end adapted to be connected to a board, and a fixed portion 182 between the contact portion 183 and the connection portion 183, and the connection portions 163 and 183 of the first and second switching terminals 16 and 18 extend in a width direction of the housing 12. With this construction, when a card 32 is not inserted into the connector yet, the first and second switching terminals 16 and 18 are securely contacted with each other, and when the card has been completely inserted, the first and second switching terminals 16 and 18 are definitely separated from each other.

(4) According to the invention, the first switching terminal 16 is provided with an inclined portion 166 inclined obliquely upward from the contact portion 161 to the fixed portion 162. Therefore, upon insertion of the card 32, the first switching terminal 16 is easily displaced obliquely downward in relation to the inserting direction of the card 32, thereby enabling the reliable detection of the card.

(5) According to the invention, upon insertion of the card 32, first the card contacts the contact A 164 of the first switching terminal 16, on proceeding of the insertion the first switching terminal 16 is displaced obliquely downward in relation to the inserting direction of the card 32, and when the card 32 has been completely inserted, the contact B 165 of the first switching terminal 16 separates from the contact portion 181 of the second switching terminal 18, thereby enabling the inserted or removed condition of the card 32 to be detected. With this construction, when a card 32 is not inserted into the connector yet, the first and second switching terminals 16 and 18 are securely contacted with each other, and when the card has been completely inserted, the first and second switching terminals 16 and 18 are definitely separated from each other.

The invention will be more fully understood by referring to the following detailed specification and claims taken in connection with the appended drawings.

DESCRIPTION OF THE PREFERRED EMBODIMENTS

Figure 1A:
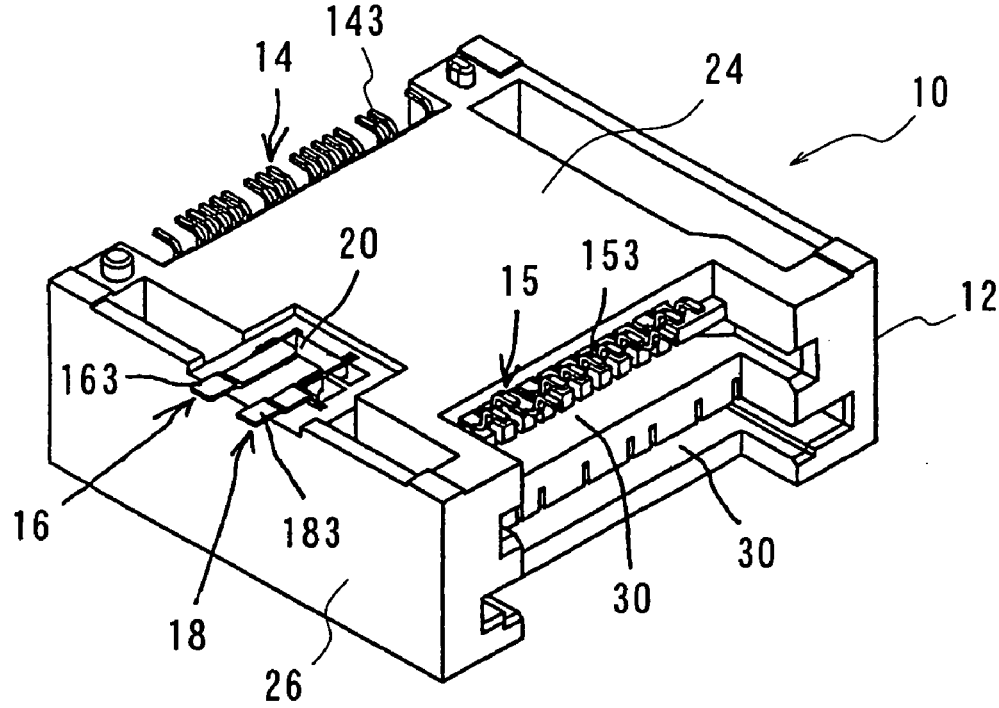
FIG. 1A is a perspective view of the card connector according to the invention viewed from the side of connection portions of the switching terminals.
Figure 1B:
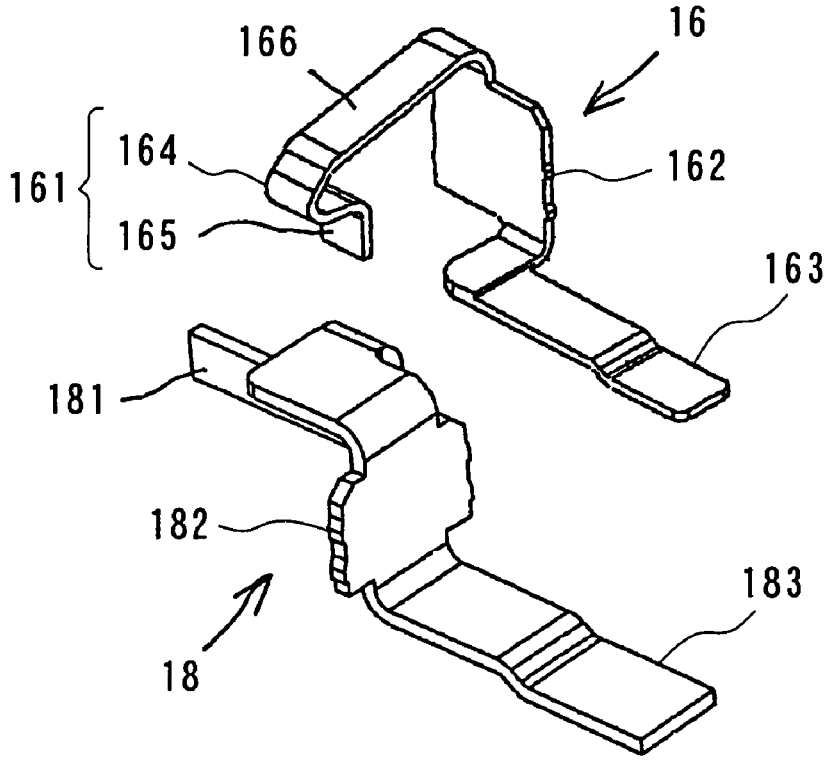
FIG. 1B is a perspective view of the first and second switching terminals according to the invention.
Figure 2A:
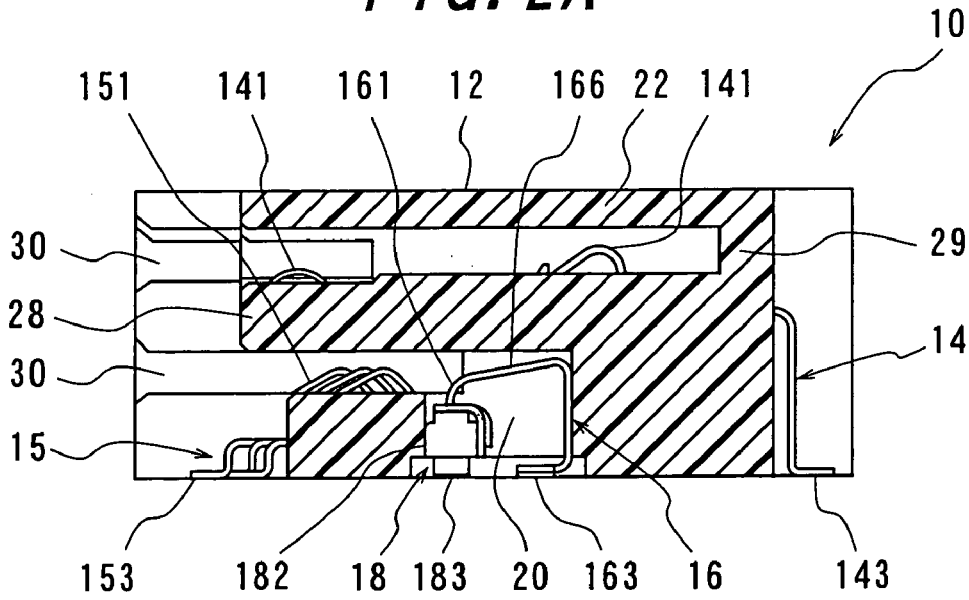
FIG. 2A is a sectional view of the card connector according to the invention prior to insertion of a card.
Figure 2B:
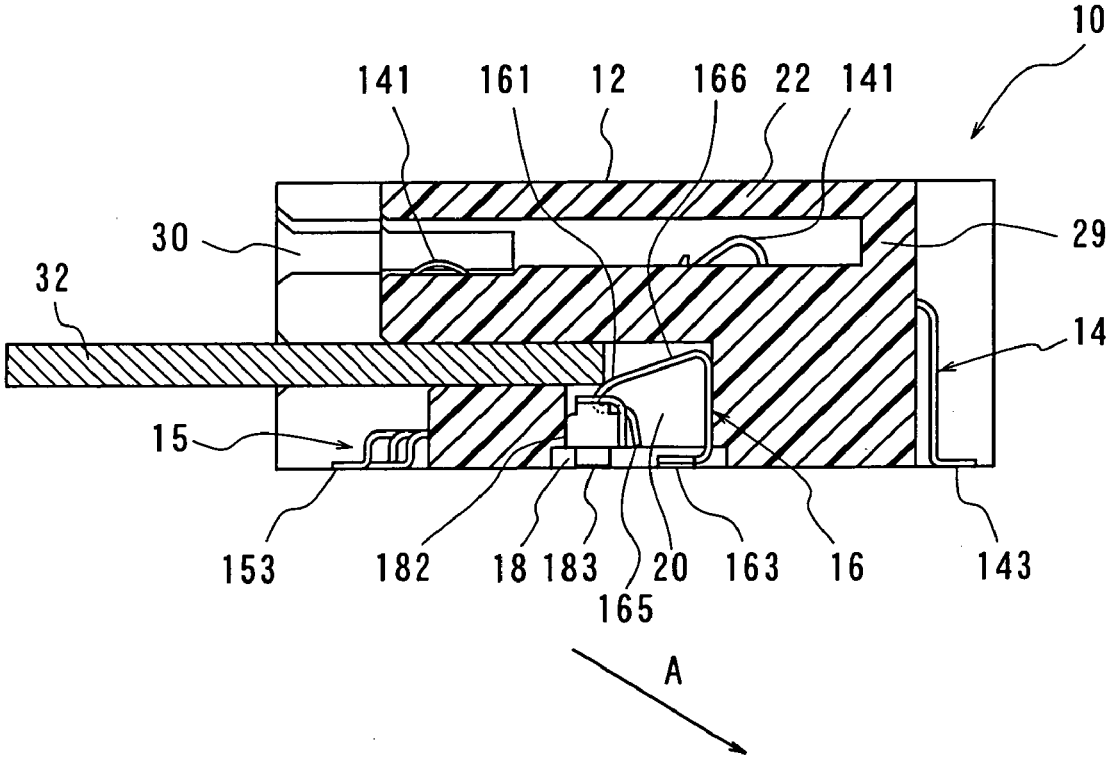
FIG. 2B is a sectional view of the card connector in FIG. 2A after the card has been completely inserted.
Figure 3A:
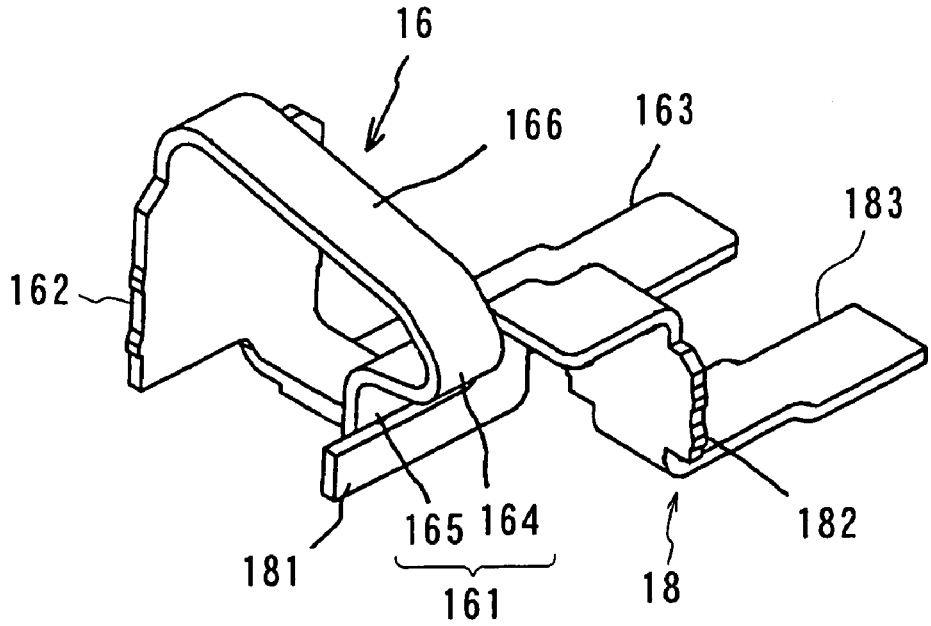
FIG. 3A is a perspective view of the switching terminals in the contacted condition according to the invention.
Figure 3B:
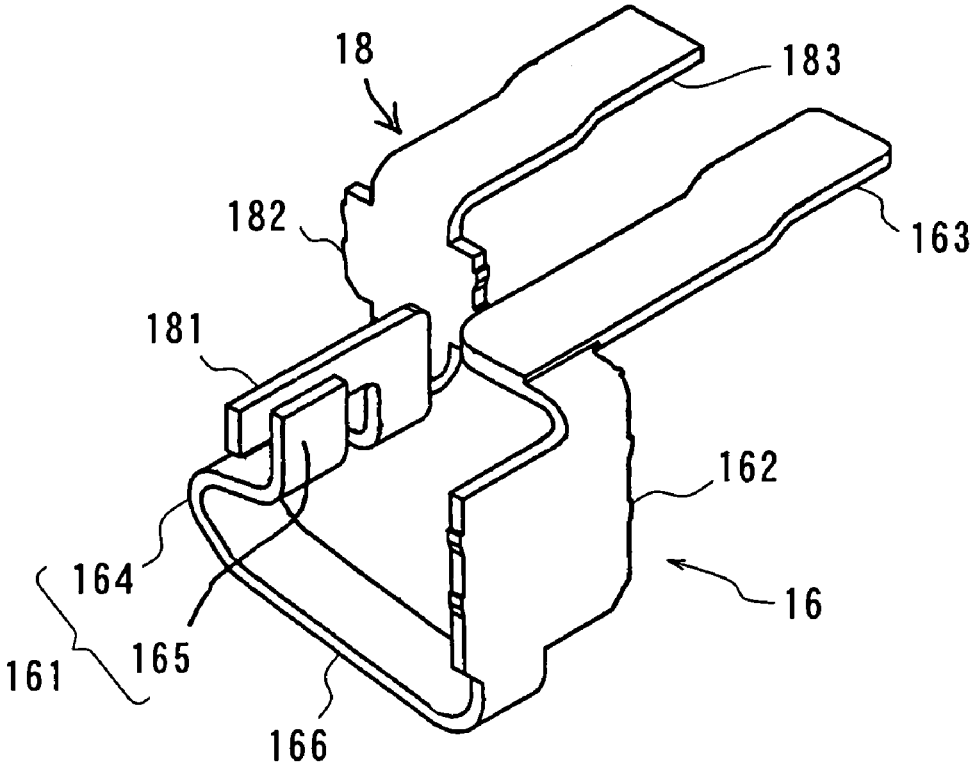
FIG. 3B is a perspective view similar to FIG. 3A but in the separated condition.
Figure 4:
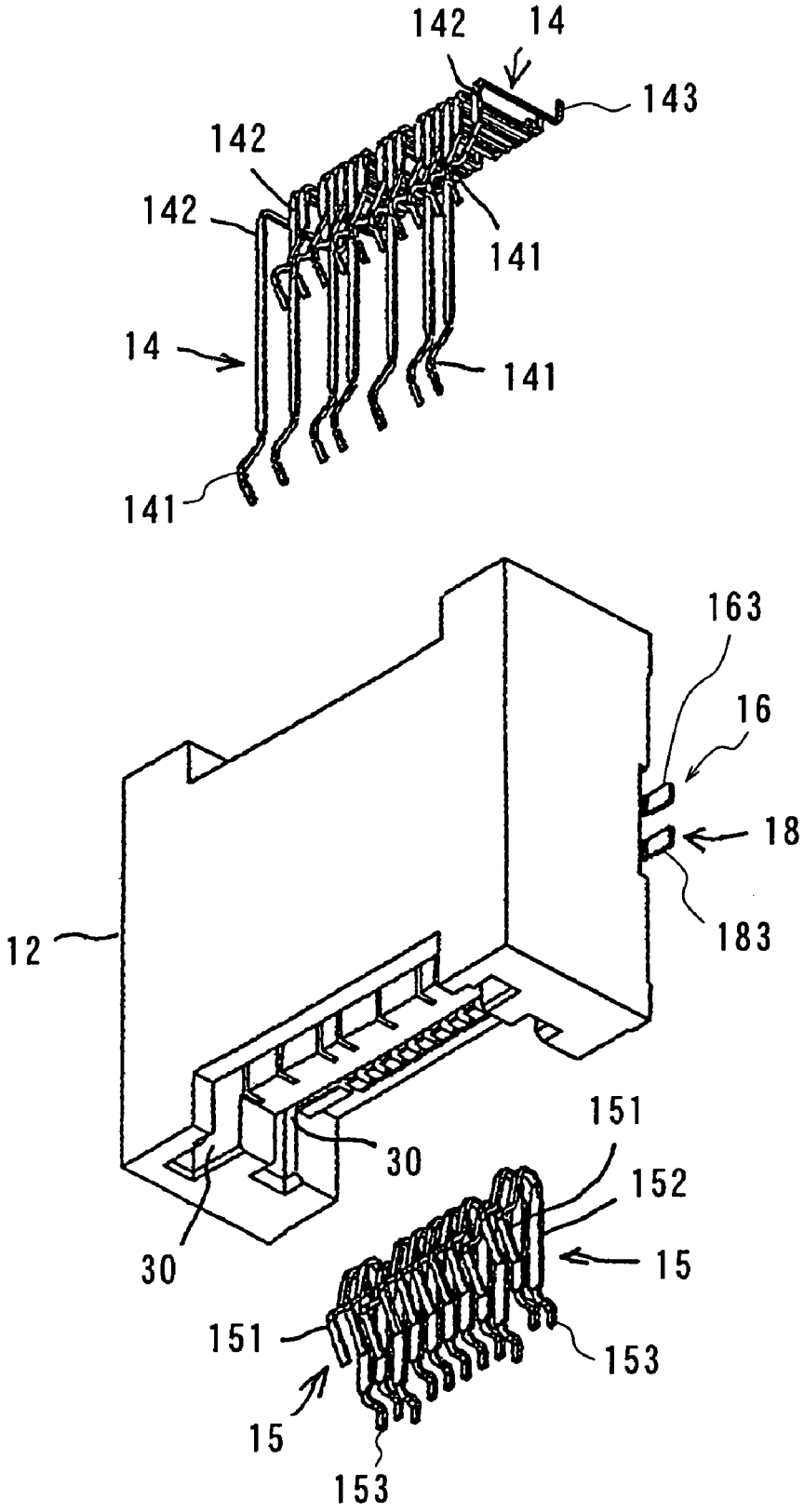
FIG. 4 is an exploded perspective view of the card connector according to the invention illustrating the housing and the contacts.
Figure 5A:
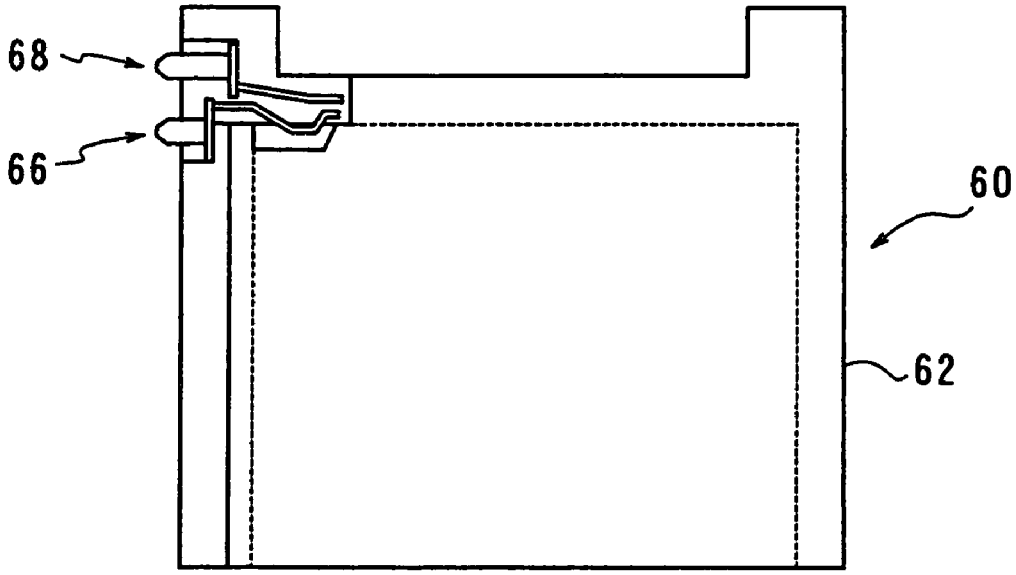
FIG. 5A PRIOR ART
FIG. 5A is a plan view of a card connector of the prior art before inserting a card.
Figure 5B:
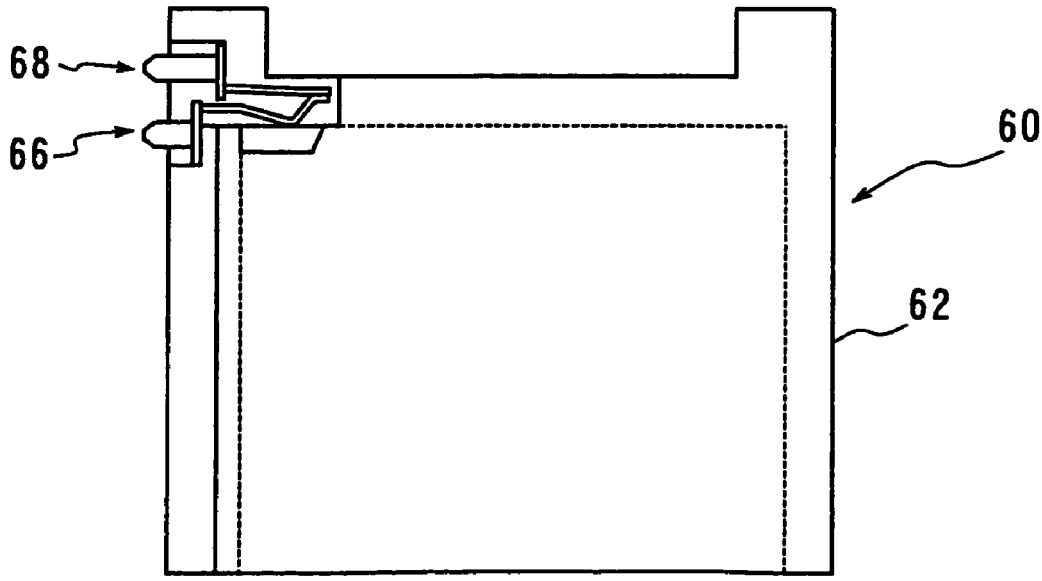
FIG. 5B PRIOR ART
FIG. 5B is a plan view of the card connector in FIG. 5A after the card has been inserted.

One embodiment of the card connector according to the invention will be explained with reference to FIGS. 1 to 4. FIG. 1A is a perspective view of the card connector viewed from its bottom side with switching terminals visible thereat, and FIG. 1B is a perspective view of a first switching terminal and a second switching terminal. FIG. 2A is a sectional view of the card connector before inserting a card thereinto, while FIG. 2B is a sectional view of the connector with a card completely inserted. FIGS. 3A and 3B are perspective views of two switching terminals for explaining their contacted and separated conditions. FIG. 4 is an exploded perspective view of the card connector showing its housing and contacts removed therefrom.

The card connector 10 according to the invention mainly comprises contacts 14 and 15, a housing 12 and two switching terminals 16 and 18.

Before explaining the components of the card connector, the card 32 will be explained. This card 32 is used for a printer, card reader or the like. The card 32 mainly comprises contact portions adapted to contact the contact portions 141 or 151 of the contacts 14 or 15, patterns connecting from the contact portions of the card to circuits, integrated circuits and central processing units mounted on the patterns, and a connection portion to be connected to the first switching terminal. Cards 32 to be used for the card connector 10 according to the invention are multimedia card (registered trademark), SD card (Secure Digital memory card) (registered trademark), memory stick card (registered trademark), SmartMedia card (registered trademark), CompactFlash card (registered trademark), xD card (registered trademark) and the like, these being IC cards having built-in CPU or IC for memory.

With the card connector 10 in the illustrated embodiment, a Memory-Stick Duo card is inserted into an inserting hole in its upper portion, while a Mini SD card is inserted into an inserting hole in the lower portion of the card connector.

First, the two switching terminals 16 and 18 will be explained, which are one subject feature of the invention. The two switching terminals are made of a metal and formed by the press-working of the known technique. Preferred materials from which to form the switching terminals 16 and 18 include brass, beryllium copper, phosphor bronze and the like to fulfil the requirements imposed thereon, such as springiness, formability and the like.

The two switching terminals 16 and 18 are contacted to each other or separated from each other, by means of which the connector makes it possible to ascertain whether a card 32 has been inserted into the connector. In the illustrated embodiment, when a card is not inserted, the terminals 16 and 18 are contacted to each other, while a card has been inserted, the two switching terminals are separated, thereby detecting whether a card 32 has been inserted or not. (Reversely, the contact of the terminals may indicate the insertion of the card.)

In the illustrated embodiment, as a Memory-Stick Duo card is inserted in the fitting opening in the upper portion of the card connector, there is no need to provided any switching mechanism in the upper portion, and the two switching terminals 16 and 18 are provided only in the lower portion of the card connector, because of this card having a signal terminal provided with a switching mechanism as a characteristic feature of this card.

First, the first switching terminal 16 will be explained. As shown in FIG. 1B, the first switching terminal 16 is substantially inverted U-shaped and comprises at least a contact portion 161 at its one end adapted to contact the card 32 and the second switching terminal 18, a connection portion 163 at the other end adapted to be connected to a board or substrate, and a fixed portion 162 between the contact portion 161 and the connection portion 163. It is preferable to provide an inclined portion 166 inclined obliquely upward between the contact portion 161 and the fixed portion 162.

The connection portion 163 of the first switching terminal 16 extends in the width direction of and on the bottom surface of the housing 12. While the connection portion 163 is shown of a surface mounting type (SMT) in the illustrated embodiment, it will be apparent that it may be of a dip type. The fixed portion 162 is fixed to the housing 12 by press-fitting in a space surrounded by bosses formed on the housing 12 in the illustrated embodiment. The contact portion 161 includes two contact portions (a contact A 164 and a contact B 165), the former being curved and adapted to contact the card 32 and the latter being plate-shaped and adapted to contact the second switching terminal 18. Different from a contact portion 181 of the second switching terminal 18, the contact portion 161 of the first switching terminal 16 is displaceable obliquely downward in relation to the inserting direction of the card when being urged by a card being inserted. The contact A 164 adapted to contact the card 32 is curved in shape as shown in FIG. 1B and contiguous to the inclined portion 166 so that it easily contact the card 32 and readily displace in the obliquely downward direction to avoid the card from being scratched. In the illustrated embodiment, the contact B 165 of the first switching terminal 16 adapted to contact the second switching terminal 18 is plate-shaped so as to easily contact the second switching terminal 18, to maintain the stable contact and to be able to recognize the insertion and removal of the card into and from the connector. The shape of the contact B 165 may be any shape insofar as the contact B 165 makes it possible to recognize the insertion and removal of the card and may be suitably design in consideration of contacting property and ability of recognition for the card. In the illustrated embodiment, both the contact B of the first switching terminal 16 and the contact portion (latter described) 181 of the second switching terminal 18 are plate-shaped. However, either of them may be curved or may be provided with a protrusion.

Second, the second switching terminal 18 will be explained. As shown in FIG. 1B, the second switching terminal 18 is substantially in the form of a crank and comprises a contact portion 181 at one end adapted to contact the first switching terminal 16, a connection portion 183 at the other end adapted to be connected to a board or substrate, and a fixed portion 182 between the contact portion 181 and the connection portion 183.

The connection portion 183 of the second switching terminal 18 extends in the width direction of and on the bottom surface of the housing 12. In the illustrated embodiment, the connection portion 183 is shown of a surface mounting type (SMT), it will be apparent that it may be of a dip type. The contact portion 181 is substantially L-shaped and extends downward (viewed in the drawing) as shown in FIG. 1B. The contact portion 181 is substantially rigid so that it is not displaced as is the case with the contact portion 161 of the first switching terminal 16, and the contact portion 181 is plate-shaped similar to the contact B 165 of the first switching terminal 16. The fixed portion is fixed to the housing by press-fitting in a space surrounded by bosses formed on the housing in the illustrated embodiment.

The positions of the first and second switching terminals 16 and 18 may be suitably designed in consideration of the size of a card to be inserted, the reliable contact of the inserted card 32 with the first switching terminal 16, and possibility of displacement of the contact portion 161 of the first switching terminal 16 obliquely downward in relation to the inserting direction of the card by pushing in the insertion direction when the card is inserted. The positions of the first and second terminals may be suitably designed further in consideration of positive separation of the contact B 165 of the contact portion 161 of the first switching terminal 16 from the contact portion 181 of the second switching terminal 18, and the possibility of outward extension of the connection portions 168 and 183 of the first and second switching terminals 16 and 18 in the width direction of the card connector 10. In the illustrated embodiment, as the length of the card is only about one half of the length of the connecter in the inserting direction, the two switching terminals 16 and 18 are arranged approximately in the proximity of the center of the connector so that their connection portions 163 and 183 extend downward from the connector at its center in its width direction as shown in FIG. 1A.

Finally, the connecting relationship between the first and second switching terminals 16 and 18 will be explained. When a card 32 is inserted into the connector shown in FIG. 2*a*, the card 32 contacts the contact A 164 of the contact portion 161 of the first switching terminal 16. Inserting the card 32 further, the first switching terminals 16 is displaced in a direction shown by an arrow A in FIG. 2B obliquely downward in relation to the inserting direction of the card. When the card 32 has been completely inserted, the first and second switching terminals 16 and 18 are separated from each other to make it possible to detect the inserted or removed condition of the card. In the illustrated embodiment, the separation of the first and second switching terminals from each other to cut off a signal to indicate that the card has been completely inserted into the connector. In more detail, when a card is not inserted in the connector yet, the contact B 165 of the first switching terminal 16 contacts the contact portion 181 of the second switching terminal 18 as shown in FIG. 3A, while if the card has been inserted in the connector completely, the contact B 165 of the first switching terminal 16 is separated from the contact portion 181 of the second switching terminal 18 as shown in FIG. 3B.

The housing 12 will then be explained. The housing 12 is injection molded from an electrically insulating plastic material in a conventional manner. Preferred materials from which to form the housing 12 include polybutylene terephthalate (PBT), polyamide (66 PA or 46 PA), liquid crystal polymer (LCP), polycarbonate (PC) and the like and combinations thereof in view of the requirements imposed on the housing such as dimensional stability, workability, manufacturing cost and the like. The housing 12 is formed with a required number of fitting openings 30 for inserting a plurality of cards 32. In the illustrated embodiment, the housing 12 is provided with a total of two fitting openings 30, one in its upper portion, and the other in the lower portion. The size of the fitting opening 30 may be suitably designed such that the card 30 can be inserted thereinto and contact the contacts 14 and 15 and the first switching terminal 16.

A Memory-Stick Duo card is inserted into the fitting opening 30 in the upper portion and a Mini SD card is inserted into the fitting opening 30 in the lower portion of the connector The two fitting openings 30 are separated by an insulating intermediate wall 28 as shown in FIG. 2A. The housing 12 is formed with inserting grooves for fixing therein a required number of contacts 14 and 15 by hooking (lancing), welding or the like in a manner that contact portions 141 and 151 of the contacts 14 and 15 extend into the fitting openings 30.

The housing 12 includes at least an upper wall 22, a lower wall 24, two side walls 26, a rear wall 29 and a required number of intermediate walls 28 (extending in longitudinally and transversely) depending upon the number of the fitting openings for cards. The fitting openings 30 for cards are completely independent from each other by the intermediate walls 28. In the illustrated embodiment, the fitting openings are two and one intermediate wall 28 is between the two fitting openings.

Finally, the contacts 14 and 15 will be explained. There are two kinds of the contacts 14 and 15 to be arranged in the upper and lower portions of the connector in the illustrated embodiments. Similarly to the switching terminals 16 and 18, the two kinds of the contacts 14 and 15 are made of a metal and formed by the press-working of the known technique. Preferred metals from which to form the contacts include brass, beryllium copper, phosphor bronze and the like to fulfil the requirements imposed thereon, such as springiness, conductivity and the like.

The two kinds of the contacts 14 and 15 each comprises at least a contact portion 141, 151 adapted to contact a card 32, a fixed portion 142, 152 to be fixed to the housing 12, and a connection portion 143, 153 to be connected to a board or substrate.

The connection portion 143 of the contact 14 adapted to contact the card 32 inserted into the fitting opening in the upper portion of the connector is so arranged as to extend in the opposite direction of the fitting opening 30, while the connection portion 153 of the contact 15 adapted to contact the card 32 inserted into the fitting opening in the lower portion of the connector is so arranged as to extend on the same side of the fitting opening 30.

As the cards 32 to be inserted into the fitting openings in the upper and lower portions of the card connector are different in positions of their contact portions, the contacts 14 and 15 are correspondingly different in the distance between the fixed portion 142, 152 and the contact portion 141, 151 of each of the contacts 14 and 15 as shown in FIG. 4. The contacts 14 to be arranged in the upper portion of the card connector are substantially L-shaped and are inserted into the housing from the opposite side (tail side) of the fitting opening 30 and fixed to the housing. The contacts 15 are substantially U-shaped and are inserted into the housing from the same side as the fitting opening 30.

While the card connector having the two fitting openings for cards 32 is shown in the above embodiment, it will be apparent that the switching mechanism is applicable to connectors regardless of the number of cards 32.

The present invention is applicable to card connector for use in a wide variety of electric and electronic appliances such as printers, card readers and the like and particularly to card connectors having a switching construction superior in detection for a card.

While the invention has been particularly shown and described with reference to the preferred embodiments thereof, it will be understood by those skilled in the art that the foregoing and other changes in form and details can be made therein without departing from the spirit and scope of the invention.

The invention claimed is:

1. A card connector into and from which at least one card is inserted and removed, including a required number of contacts having a contact portion adapted to contact the card, a housing holding and arranging said contacts therein and having a fitting opening into which the card is inserted, and switching means for detecting the insertion and removal of the card, wherein the switching means comprises a first switching terminal and a second switching terminal, and when the card is not yet inserted into the connector, the first and second switching terminals contact each other or do not contact each other, and when the card has been inserted into the connector, the first switching terminal is displaced obliquely downward in relation to the inserting direction of the card so that the first and second switching terminals do not contact each other or contact each other, thereby enabling the inserted or removed condition of said card to be detected, wherein the first switching terminal is provided with an inclined portion inclined obliquely upward from the contact portion to the fixed portion.

2. The card connector as set forth in claim 1, wherein said first switching terminal is substantially U-shaped and has a contact portion at one end adapted to contact said card and said second switching terminal, a connection portion at the other end to be connected to a board, and a fixed portion between said contact portion and said connection portion, and said second switching terminal is substantially crank-shaped and has a contact portion at one end adapted to contact said first switching terminal, a connection portion at the other end adapted to be connected to a board, and a fixed portion between said contact portion and said connection portion, and said connection portions of the first and second switching terminals extend in a width direction of said housing.

3. The card connector as set forth in claim 1, wherein upon insertion of the card, first the card contacts a first contact of the first switching terminal, upon further insertion of the card the first switching terminal is displaced obliquely downward in relation to the inserting direction of the card, and when the card has been completely inserted, a second contact of the first switching terminal separates from the contact portion of the second switching terminal, thereby enabling the inserted or removed condition of the card to be detected.

4. A card connector into and from which two cards are inserted and removed in upper and lower portions of the connector, including a required number of contacts having a contact portion adapted to contact the cards, a housing holding and arranging said contacts therein and having a fitting openings into which the cards are inserted, respectively, and switching means for detecting the insertion and removal of the cards, wherein the switching means comprises a first switching terminal and a second switching terminal, and when the card is not yet inserted into the connector, the first and second switching terminals contact each other or do not contact each other, and when the card has been inserted into the connector, the first switching terminal is displaced obliquely downward in relation to the inserting direction of the card so that the first and second switching terminals do not contact each other or contact each other, thereby enabling the inserted or removed condition of said card to be detected, wherein the first switching terminal is provided with an inclined portion inclined obliquely upward from the contact portion to the fixed portion.

5. The card connector as set forth in claim 4, wherein said first switching terminal is substantially U-shaped and has a contact portion at one end adapted to contact said card and said second switching terminal, a connection portion at the other end to be connected to a board, and a fixed portion between said contact portion and said connection portion, and said second switching terminal is substantially crank-shaped and has a contact portion at one end adapted to contact said first switching terminal, a connection portion at the other end adapted to be connected to a board, and a fixed portion between said contact portion and said connection portion, and said connection portions of the first and second switching terminals extend in a width direction of said housing.

6. The card connector as set forth in claim 4, wherein upon insertion of the card, first the card contacts a first contact of the first switching terminal, on proceeding of the insertion the first switching terminal is displaced obliquely downward in relation to the inserting direction of the card, and when the card has been completely inserted, a second contact of the first switching terminal separates from the contact portion of the second switching terminal, thereby enabling the inserted or removed condition of the card to be detected.

* * * * *